United States Patent [19]

Yoneda et al.

[11] Patent Number: 4,510,719

[45] Date of Patent: Apr. 16, 1985

[54] METHOD OF GRINDING A CURVED CORNER PORTION

[75] Inventors: Takao Yoneda, Toyoake; Yasuji Sakakibara, Hekinan, both of Japan

[73] Assignee: Toyoda Koki Kabushiki Kaisha, Kariya, Japan

[21] Appl. No.: 396,332

[22] Filed: Jul. 8, 1982

[30] Foreign Application Priority Data

Aug. 28, 1981 [JP] Japan ..... 56-135834

[51] Int. Cl.[3] ..... B24B 1/00

[52] U.S. Cl. ..... 51/289 R; 51/327

[58] Field of Search ..... 51/289 R, 326, 327, 51/105 SP, 165 R

[56] References Cited

U.S. PATENT DOCUMENTS 4,337,599 7/1983 Koide et al. ..... 51/289 R

OTHER PUBLICATIONS

Japanese Published Unexamined Patent Application No. 56-3168, filed: Jun. 25, 1979; published: Jan. 13, 1981.

Werkstatt und Betrieb 110 (1977)8, "Einsatz von NC--Rundschleifmaschinen" by Ulrich Vetter, pp. 457-477, particularly Bild 3.

Instruction Manual "Automatic Computer Control Step-Master and Plunge-Master Grinding Systems" having a copyright mark of registration in 1980 by The Warner & Swasey Co., FIG. 1, p. 6-1.

*Primary Examiner*—Frederick R. Schmidt
*Assistant Examiner*—Robert Rose
*Attorney, Agent, or Firm*—Oblon, Fisher, Spivak, McClelland & Maier

[57] ABSTRACT

A method of grinding a curved corner portion of a workpiece by a grinding wheel having a curved edge surface whose radius is smaller than that of said curved corner portion. The grinding wheel is movable along a path extending at an acute angle to the axis of rotation of the workpiece. First, the grinding wheel is relatively moved to a first grinding start position. Then, the grinding wheel is moved inwardly to an advanced position along the path so as to perform a plunge grinding operation, and is subsequently retracted to the grinding start position. After that, the grinding wheel and the workpiece are relatively moved so as to move the grinding start position to the next grinding start position along a curved arc which is in parallel with the curved corner portion of the workpiece. The above plunge grinding operation is repeatedly performed from each grinding start position thereby grinding the curved corner position.

8 Claims, 6 Drawing Figures

| | | |
|---|---|---|
| 1 | XP1 | YP1 |
| 2 | XP2 | YP2 |
| ⋮ | ⋮ | ⋮ |
| n | XPn | YPn |
| | ⋮ | ⋮ |

| | | |
|---|---|---|
| 1' | XP1' | YP1' |
| 2' | XP2' | YP2' |
| ⋮ | ⋮ | ⋮ |
| n' | XPn' | YPn' |
| | ⋮ | ⋮ |

METHOD OF GRINDING A CURVED CORNER PORTION

BACKGROUND OF THE INVENTION

1. Field of the Invention

The present invention relates to a method of grinding a curved corner portion of a workpiece by a grinding wheel whose edge has a curvature radius smaller than that of the curved corner portion.

2. Description of the Prior Art

In a conventional method of grinding a curved corner portion, whose curvature radius is larger than that of an edge portion of a grinding wheel, the grinding wheel is first moved inwardly through a predetermined distance to grind the curved corner portion at the time when the grinding wheel G is located at the end portion of the curved corner portion. Next, the grinding wheel is moved along the profile of the curved corner portion at a predetermined feed rate by controlling the relative movement of the grinding wheel and the workpiece so as to grind the curved corner portion. In this method, however, the grinding efficiency is low because only abrasive grains which are disposed at the side of the advance are effective to grind the workpiece. Therefore, the infeed amount of the grinding wheel per each traverse feed movement of the workpiece must be small, and the traverse feed rate cannot be high.

To overcome this drawback, it has been proposed to grind the curved corner portion with a plunge grinding operation just as grinding a cylindrical portion of the workpiece. In this method, the grinding wheel is first retracted from an advanced position to a predetermined retracted position, and then the table is moved so as to relatively position the workpiece at a grinding start position. Subsequently, the grinding wheel is moved inwardly from the grinding start position to the advanced position to perform a plunge grinding operation for grinding a portion of the curved corner portion. In this method, since each retracted position or grinding start position is included in a line extending parallel to the axis of rotation of the workpiece, the movement amount of the grinding wheel from the grinding start position to the advanced position is changed depending on the movement of the grinding wheel along the axis of the workpiece. This results in the increase of air-cut grinding feed amount which is not effective in actual grinding. Therefore, the grinding cycle time cannot be shortened.

SUMMARY OF THE INVENTION

It is, therefore an object of the present invention to provide an improved method of grinding a curved corner portion of a workpiece in a shortened cycle time.

Another object of the present invention is to provide an improved method of grinding a curved corner portion of a workpiece in a shortened cycle time by moving the grinding start position of the grinding wheel along the profile of the curved corner position.

Briefly, according to the present invention, these and other objects are achieved by providing a method of grinding a curved corner portion of a workpiece, as mentioned below. The worpiece is rotated about a first axis. A grinding wheel is rotated, wherein the grinding wheel has a curved edge surface whose curvature radius is smaller than that of the curved portion of the workpiece. Relative movement between the rotating workpiece and the rotating grinding wheel is effected so as to position the rotating grinding wheel at a grinding start position. The grinding wheel is moved inwardly by a first distance from the grinding start position to an advanced position along a path extending at an acute angle to the first axis so as to permit the curved edge surface of the grinding wheel to grind the curved corner portion of the workpiece. The grinding wheel is moved outwardly by the first distance from the advance position to the grinding start position along the path. Relative movement between the workpiece and the grinding wheel is effected so as to move the grinding start position to the next grinding start position along a first curved arc which is offset from a second curved arc in the moving direction of the grindng wheel, the second curved arc being in concentric relation with the desired profile of the curved corner portion. The steps of moving the grinding wheel inwardly, of moving the grinding wheel outwardly, and of moving the grinding start position to the next grinding start position are then repeated.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which:

FIGS. 5(*a*) and 5(*b*) illustrate the contents of the memory shown in FIG. 2 for storing pulse numbers required for the plunge grinding operations.

DETAILED DESCRIPTION OF THE PREFERRED EMBODIMENT

Figure 1:
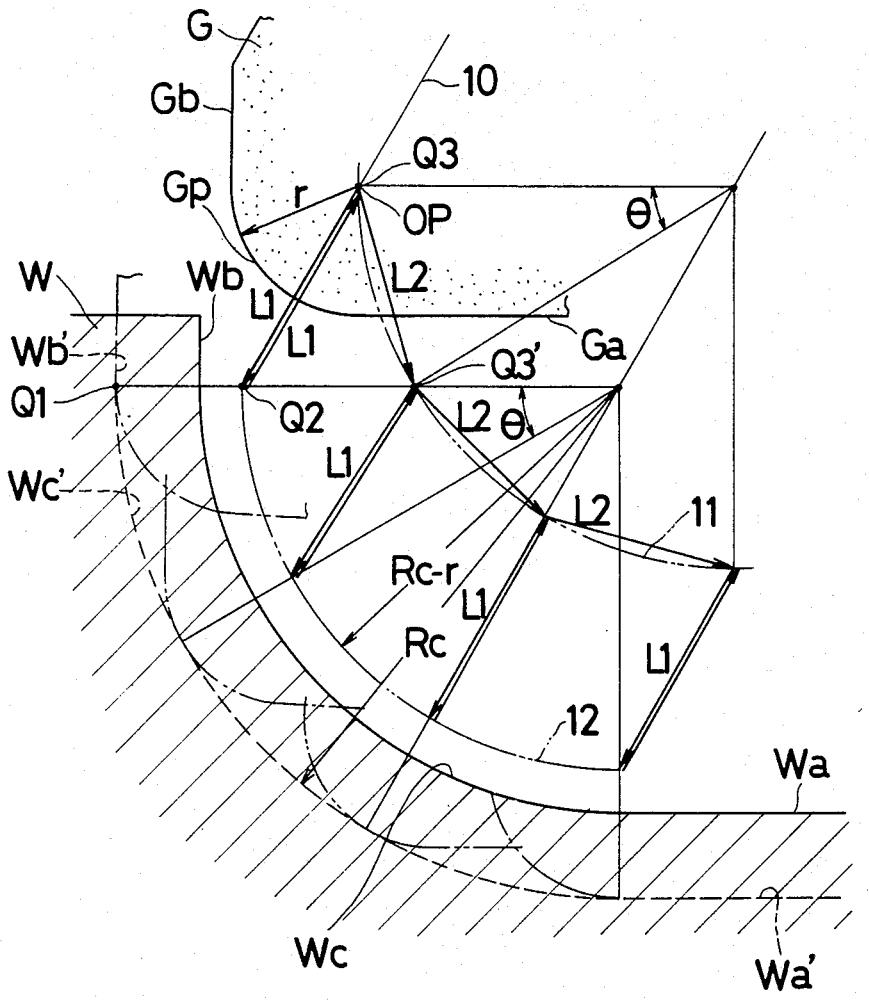
FIG. 1 is an illustration depicting the movement of a grinding wheel relative to a workpiece for grinding the curved corner portion of the workpiece in accordance with the present invention.

Referring now to the drawings, wherein like reference numerals or characters refer to identical or corresponding parts throughout the several views, and more particularly to FIG. 1, there is illustrated a plunge grinding cycle for roughly grinding a curved corner portion Wc of a workpiece W according to the present invention. In this embodiment, the curved corner portion Wc is assumed to have a circular profile. A reference character G denotes a grinding wheel for grinding the workpiece W. The grinding wheel G is movable along a path 10 extending at an acute angle to the axis of rotation of the workpiece W. The grinding wheel G is formed at its periphery with a first grinding surface Ga extending parallel to the axis of rotation of the workpiece W, a second grinding surface Gb extending perpendicular to the first grinding surface Ga, and a curved edge surface Gp connected between the first and second grinding surfaces Ga and Gb. In this embodiment, the curved edge surface Gp has a circular profile. The circular edge surfaces Gp has a radius r, whose center OP is included in the path 10. The workpiece W has a cylindrical portion Wa, a shoulder portion Wb and the circular corner portion Wc, and Wa', Wb' and Wc' indicate the finished surfaces of the portions Wa, Wb and Wc, respectively. The radius r of the curved edge surface of the grinding wheel G is smaller than the radius of the circular corner portion Wc of the workpiece W.

The plunge grinding cycle for roughly grinding the circular corner portion Wc according to the present invention is performed in the following manner. First, the center OP of the circular edge surface Gp is positioned at a predetermined point Q3, which is regarded as a first grinding start position. The point Q3 is spaced apart from the point Q2 along the path 10 by a predetermined distance L1, wherein the point Q2 is spaced apart from a point Q1 along the axis of rotation of the workpiece W by a distance equal to the radius r of the circular edge surface Gp, and the point Q1 is the intersection between the finished shoulder portion Wb' and the finished circular corner portion Wc'. Next, the grinding wheel G is moved inwardly by the distance L1 along the path 10 so as to locate the center OP at the point Q2 which is regarded as a first advanced position. As a result, the plunge grinding operation is performed for grinding a partial portion of the shoulder and circular corner portions Wb and Wc. The grinding wheel G is subsequently retracted along the path 10 by the distance L1 to the first grinding start position Q3. Then, the grinding wheel G is moved to a next grinding start position Q3' by controlling the relative movement between the grinding wheel G and the workpiece W in such a manner that the center OP is moved nearly along a circular arc 11 by a linear distance L2. After this positioning, the grinding wheel G is again moved inwardly along a path parallel to the path 10 by the distance L1 to a next advanced position so as to perform the plunge grinding operation for grinding another part of the circular corner portion Wc. At this time, the edge of the circular edge surface Gp reaches the finished circular corner portion Wc', as shown in phantom lines in FIG. 1, while the center OP reaches a circular arc 12 which extends through the point Q2 and is concentric with the finished circular corner portion Wc'. The circular corner portion Wc is ground with the above operations being repeated.

It is to be noted that the circular arc 11 and the circular arc 12 are the same but offset from each other along the path 10 by the distance L1. Accordingly, the movement amount L1 of the grinding wheel G from the grinding start position to the advanced position is always the same because the grinding start positions are moved following the circular arc 11. Therefore, the grinding cycle time can be greatly reduced by setting the distance L1 to be a proper amount.

Figure 2:
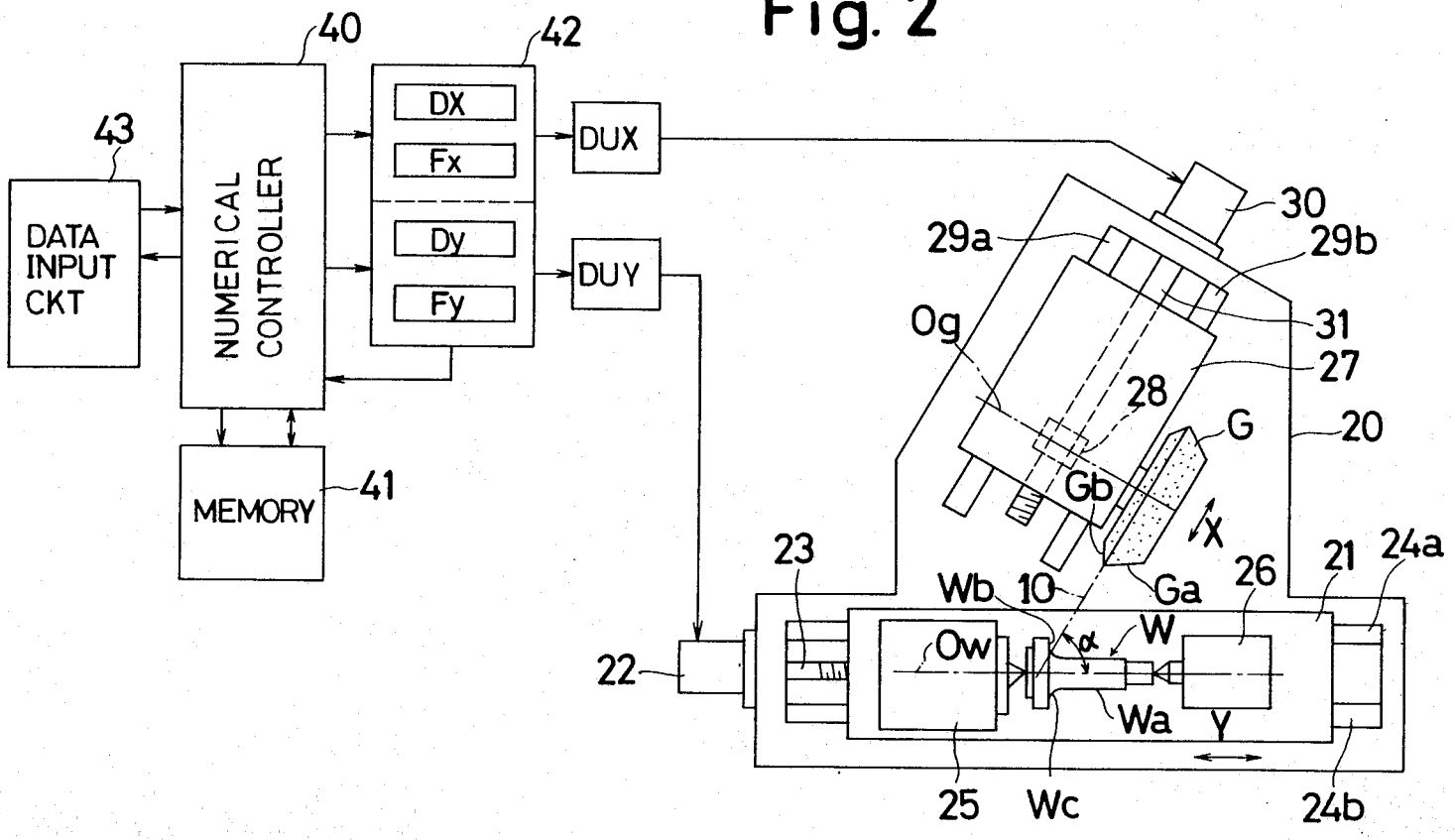
FIG. 2 is a plan view of a grinding machine connected to a control circuit therefor for performing a plunge grinding operation in accordance with the present invention.

FIG. 2 show a grinding machine which is capable of performing the above grinding cycle shown in FIG. 1. A reference numeral 20 denotes a bed. A work table 21 is mounted on the front portion of the bed 20 to be slidable along a Y-axis direction through a pair of guide ways 24*a* and 24*b*. The work table 21 is threadedly engaged with a feed screw shaft 23 which is drivingly connected to a pulse motor 22. A headstock 25 and a tailstock 26 are mounted on the work table 21 to rotatably support the workpiece W having the cylindrical portion Wa, the shoulder portion Wb and the circular corner portion Wc. The workpiece W is rotated by a drive motor, not shown, in a usual manner. The axis Ow of the workpiece W is parallel to the pair of guide ways 24*a* and 24*b* and makes an acute angle $\alpha$ with the path 10 of the grinding wheel G along an X-axis direction. A wheel head 27 rotatably carrying the angular type grinding wheel G is slidably mounted on the bed 20 through a pair of guide ways 29*a* and 29*b*, so that the grinding wheel G formed with the first, second and circular edge surfaces Ga, Gb and Gp is movable along the path 10. The grinding wheel G is rotated about an axis Oo by a drive motor, not shown, in a usual manner. The wheel head 27 is threadedly engaged through a nut 28 with a feed screw shaft 31 which is drivingly connected to a pulse motor 30.

A description is now made of a control device for grinding the workpiece W with the above-described grinding machine. A numerical controller 40, which may be a digital computer, is connected to a memory 41, a pulse generating circuit 42, and a data input circuit 43. The memory 41 stores therein various data required for grinding operations. The data input circuit 43 is used to store the necessary data in the memory 41 through the numerical controller 40. The pulse generating circuit 42 receives various data, such as feed amount and feed rate, from the numerical controller 40 and stores them in internal registers Dx, Fx, Dy and Fy. The pulse generating circuit 42 generates pulses in accordance with the data stored in the registers Dx, Fx, Dy and Fy. The pulses are simultaneously distributed to drive units DUX and DUY so as to drive the pulse motors 22 and 30 and to cause the relative movement between the grindng wheel G and the workpiece W. The registers Dx and Dy are used for controlling the movement amounts of the wheel head 27 and the work table 21, respectively, while the registers Fx and Fy are used for controlling the moving speeds of the wheel hand 27 and the work table 21, respectively.

Figure 3:
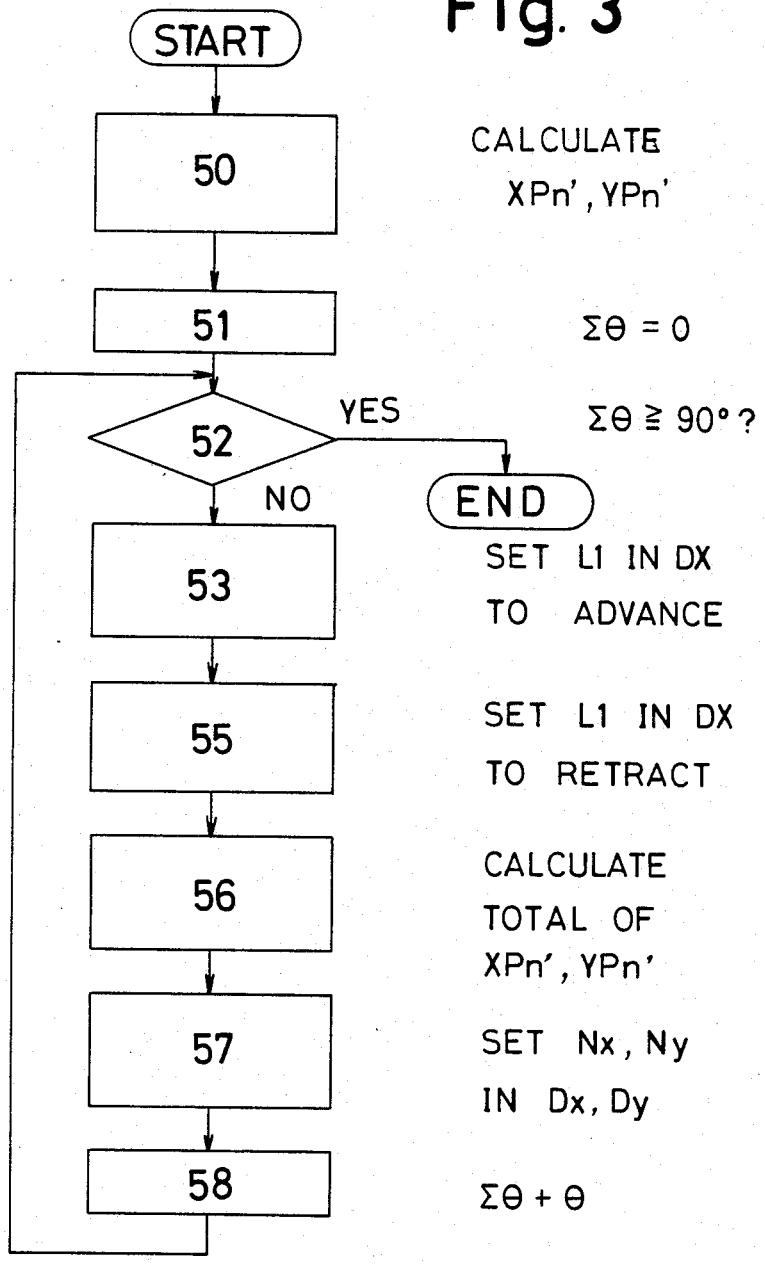
FIG. 3 is a flow chart illustrating an operation of a numerical controller shown in FIG. 2.

The operation of the numerical controller 40 for the above plunge grinding operation is now described with reference to the flow chart shown in FIG. 3. The operaiton is started, when the grinding wheel G is positioned as shown in solid lines in FIG. 1 and a G code for initiating the plunge grinding cycle is read out from the memory 41.

Figures 4, 5A, 5B:
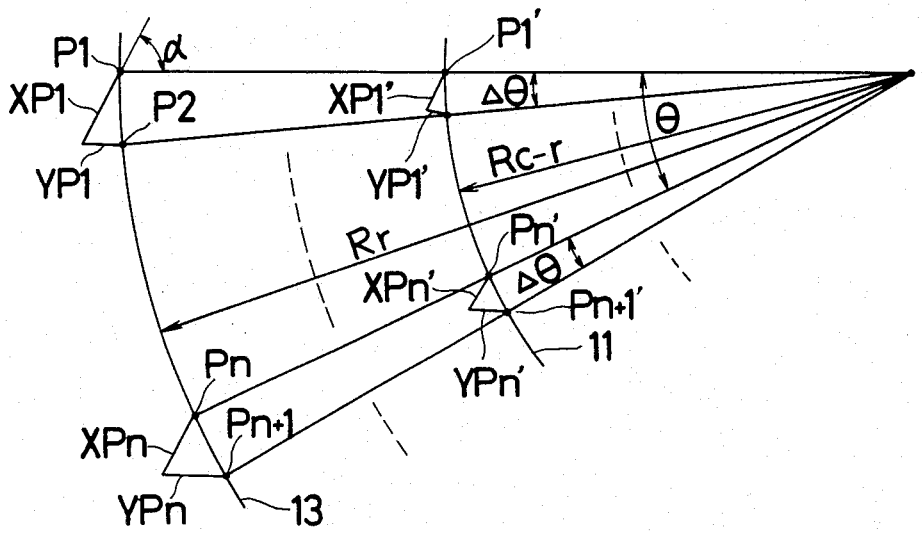
FIG. 4 is an illustration depicting the positional relationship between a circular arc shown in FIG. 1 and a reference circular arc used for definition of the profile of the circular corner portion.

Step 50 is provided to calculate pulse numbers XPn' and YPn' from pulse numbers XPn and YPn stored in the memory 41, and to store the same in the memory 41. As shown in FIG. 5(*a*), the memory 41 stores therein plural sets of pulse numbers XPn and YPn corresponding to points Pn of a reference circle 13 shown in FIG. 4. The pulse numbers XPn and YPn of each set indicate pulse numbers to be distributed to the drive units DUX and DUY to move the center OP by a small rotational angle $\Delta\theta$ from one point Pn to the next point Pn+1 of the reference circular arc 13. In other words, the pulse numbers XPn and YPn define the profile or the curved surface of the finished circular corner portion Wc'. The calculated pulse numbers XPn' and YPn' correspond to pulse numbers to be distributed to move the center OP by the rotational angle $\Delta\theta$ from a point Pn' to the next point Pn+1' of the circular arc 11. These calculated pulse numbers XPn' and YPn' may be used in order that the center OP of the grinding wheel G is moved following the circular arc 12 so as to perform a finish grinding operation of the circular corner portion Wc, referred to hereinafter.

For the plunge grinding operations for roughly grinding the circular corner portion Wc, however, it is not necessary to perform the plunge grinding operation at every small angle $\Delta\theta$. Accordingly, a larger angle $\theta$ is calculated by cumulating a predetermined number of small angles $\Delta\theta$, and the plunge grinding operation is performed at every angle $\theta$, in other words, it is performed after the center OP of the grinding wheel G is moved by the angle $\theta$ from one grinding start position to the next one, as shown in FIG. 1.

In this embodiment, the reference circle 13 is divided into plural parts so that the angular interval $\Delta\theta$ between one point Pn and the next point Pn+1 is the same. The numbers XP'n and YP'n are obtained by calculating the numbers XPn and YPn based on the following equations (1) and (2):

$$XPn' = \{XPn \cdot (Rc - r)\}/Rr \quad (1)$$

$$Ypn' = \{YPn \cdot (Rc - r)\}/Rr \quad (2)$$

Where Rc represents the radius of the finished circular corner portion Wc', and Rr represents the radius of the reference circular arc 13.

The following steps 51 to 58 are provided for performing the plunge grinding operation for roughly grinding the circular corner portion Wc, using the pulse numbers XPn' and YPn' stored in the memory 41 as shown in FIG. 5(*b*).

More specifically, in step 51, the numerical controller 40 resets the content of a register which stores cumulative angles $\Sigma\theta$, which is the total of the angles $\theta$ from the first grinding start position P3. In this embodiment, the register is a portion of the memory 41, but it may be an independent memory or register. In step 52, it is checked whether the cumulative angles $\Sigma\theta$ stored in the register are more than 90° (degrees). In this case, since the register has been reset, the processing step advances to step 53. Steps 53 to 58 will be repeated until the cumulative angles $\Sigma\theta$ is ascertained to be more than 90° in step 52. In step 53, the numerical controller 40 sets into the register Dx a predetermined pulse number corresponding to the distance L1 and into the register Fx a data corresponding to a predetermined feed rate. As a result, the pulse generating circuit 42 distributes the corresponding number of pulses to the drive unit DUX so that the grinding wheel G is moved inwardly from the first grinding position Q3 to the advanced position Q2 along the path 10 by the distance L1 thereby to perform the plunge grinding operation for roughly grinding a portion of the circular corner portion Wc at the corresponding feed rate.

In the following step 55, the numerical controller 40 sets into the register Dx the pulse number corresponding to the distance L1 and into the register Fx a data corresponding to a predetermined rapid return rate. Further, the numerical controller 40 outputs a command to retract the grinding wheel G. As a result, the pulse generating circuit 42 outputs pulses to the drive unit DUX so that the grinding wheel G is retracted at the rapid return rate from the advanced position Q2 to the previous grinding start position Q3 shown in FIG. 1.

The next step 56 is provided to calculate pulse numbers Nx and Ny required for moving the center OP from one grinding start position to the next grinding start position by the angle $\theta$. Since the angle $\theta$ is a multiple of the small angle $\Delta\theta$, the pulse numbers Nx and Ny can respectively be obtained by cumulating every calculated pulse numbers XPn' and YPn' of the points Pn' which are included in the angle $\theta$. For example, if the center OP is to be moved by the angular amount $\theta$, which is equal to $(n-1)\cdot\Delta\theta$, from the point P1' to the point Pn' shown in FIG. 4, the pulse number Nx is the total of the pulse numbers XP1', XP2' . . . and XPn−1' shown in FIG. 5(*b*). The pulse number Ny is obtained similarly.

In step 57, the numerical controller 40 sets into the registers Dx and Dy the calculated pulse numbers Nx and Ny and into the registers Fx and Fy data corresponding to a preset travel speed of the grinding wheel G, so that the center OP is moved from one grinding start position to the next grinding start position at the preset travel speed.

In step 58, the angular amount $\theta$ is added to the content $\Sigma\theta$ of the register, and then the processing operation advances to step 52. With the steps 52 to 58 being repeated, the circular corner portion Wc is roughly ground with the plunge grinding operations.

If it is ascertained in step 52 that the content $\Sigma\theta$ of the register is more than 90°, the plunge grinding operation is judged to be completed.

Subsequently, a processing operation, not shown, for performing a finish grinding operation is executed. The roughly ground surface of the circular corner portion Wc is finished by a traverse grinding operation in such a manner that the center OP of the grinding wheel G is moved following the circular arc 12 in accordance with the calculated pulse numbers XPn' and YPn' shown in FIG. 5(*b*).

In this embodiment, the position of the grinding wheel G is controlled based on the center OP of the circular edge surface Gp. However, the intersection between the first and second grinding surfaces Ga and Gb may be used instead of the center OP.

Further, the center OP may be moved either linearly through linear interpolation or following the circular arc 11 through circular interpolation from one grinding start position to the next grinding start position. Furthermore, in this embodiment, the profile of the corner portion Wc is a circular curve, but it will be appreciated that the method of the present invention can be applied to other curved profiles.

Furthermore, the plunge grinding operation may be started from the cylindrical portion Wa toward the shoulder portion Wb.

As mentioned above, according to the present invention, prior to the grinding infeed, the grinding start position of the grinding wheel G is moved along a circular arc 11 which is offset from a second circular arc 12 in the moving direction of the grinding wheel G, the second circular arc 12 being in concentric relation with the circular corner portion Wc of the workpiece W. Therefore, the grinding feed amount is always the same. This permits the reduction of the grinding cycle time by setting an air-cut grinding infeed amount to be minimum throughout the grinding range of the circular portion Wc.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of grinding a curved corner portion of a workpiece by a grinding wheel having a curved edge surface whose curvature radius is smaller than that of said curved corner portion, said method comprising the steps of:

rotating said workpiece about a first axis, said workpiece being movable relative to said grinding wheel along a first path parallel to said first axis;

rotating said grinding wheel which is movable relative to said workpiece along a second path extending at an acute angle to said first path;

effecting relative movement between said rotating workpiece and said rotating grinding wheel along said first and second paths so as to position said rotating grinding wheel at a first grinding start position;

moving said grinding wheel inwardly by a predetermined distance from said grinding start position to an advanced position along said second path so as to permit said curved edge surface of said grinding wheel to grind a part of said curved corner portion of said workpiece;

moving said grinding wheel outwardly by said predetermined distance from said advanced position to said grinding start position along said second path;

moving simultaneously said workpiece and said grinding wheel respectively along said first and second paths so as to move said grinding start position to a next grinding start position along a path approximating a first curved arc which is offset from a second curved arc in a direction of said second path, said second curved arc being in concentric relation with the desired profile of said curved corner portion; and repeating the steps of moving said grinding wheel inwardly, of moving said grinding wheel outwardly, and of moving said grinding start position to a subsequent next grinding start position;

said first curved arc being so defined that said grinding wheel is prevented from engaging said workpiece when moved from one of said grinding start positions to a next grinding start position along said first curved arc.

2. A method as set forth in claim 1, wherein said grinding wheel is rotatable about a second axis perpendicular to said second path.

3. A method as set forth in claim 2, further comprising the step of moving said grinding wheel, after the step of repeating the steps, along said second curved arc which is in concentric relation with said desired profile of said curved corner portion thereby performing a grinding operation of said curved corner portion, wherein said advanced position is included in said second curved arc.

4. A method as set forth in claim 3, wherein said grinding wheel is formed with a first grinding surface extending parallel to said first axis and a second grinding surface extending perpendicular to said first axis, said curved edge surface being connected between said first and second grinding surfaces.

5. A method as set forth in claim 4, wherein said workpiece has a cylindrical portion and a shoulder portion, said curved corner portion being connected between said cylindrical and shoulder portions.

6. A method as set forth in claim 5, wherein said curved corner portion of said workpiece is a circular corner portion, said curved edge surface of said grinding wheel is a circular edge surface, said first curved arc is a circular arc, and said second curved arc is a circular arc.

7. A method as set forth in claim 1, wherein:

said first curved arc is offset from said second curved arc by said predetermined distance in the direction of said second path.

8. A method as set forth in claim 7, wherein:

said grinding wheel is moved at a rapid feed rate when moved in the step of moving said grinding wheel outwardly.

* * * * *